US005403967A

United States Patent [19]

Takano

[11] Patent Number: 5,403,967

[45] Date of Patent: Apr. 4, 1995

[54] ELECTRONIC MUSICAL INSTRUMENT HAVING MELODY CORRECTION CAPABILITIES

[75] Inventor: Junichi Takano, Shizuoka, Japan

[73] Assignee: Kabushiki Kaisha Kawai Gakki Seisakusho, Hamatsu, Japan

[21] Appl. No.: 125,532

[22] Filed: Sep. 22, 1993

[30] Foreign Application Priority Data

Oct. 5, 1992 [JP] Japan ..... 4-288142

[51] Int. Cl.[6] ..... G10H 1/38

[52] U.S. Cl. ..... 84/613; 84/650; 84/DIG. 22

[58] Field of Search ..... 84/613, 637, 649–652, 84/669, 715, DIG. 22

[56] References Cited

U.S. PATENT DOCUMENTS 4,152,964 5/1979 Waage ..... 84/DIG. 22

5,088,380 2/1992 Minamitaka ..... 84/637

*Primary Examiner*—Stanley J. Witkowski

*Attorney, Agent, or Firm*—Westman, Champlin & Kelly

[57] ABSTRACT

Electronic musical instruments in which if a chord is specified for a melody, a scale suitable for the chord function can automatically be selected for the specified chord type to play the melody. The electronic musical instruments have means selecting a scale corresponding to a chord when a chord progression and a key are specified For a melody pattern, and pitch shift means which performs transposition of each tone according to the chord thereby to modify the pitch so as to accord with the scale.

7 Claims, 7 Drawing Sheets

FIG. 5

NOTE VS. NUMERIC VALUE TABLE

| A | A# | B | C | C# | D | D# | E | F | F# | G | G# |
|---|---|---|---|---|---|---|---|---|---|---|---|
| 0 | 1 | 2 | 3 | 4 | 5 | 6 | 7 | 8 | 9 | 10 | 11 |

FIG. 6A (P - R) VS. S TABLE

| P - R | 0 | 1 | 2 | 3 | 4 | 5 | 6 | 7 | 8 | 9 | 10 | 11 |
|---|---|---|---|---|---|---|---|---|---|---|---|---|
| S | I | II$^b$ | II | III$^b$ | III | IV | V$^b$ | V | VI$^b$ | VI | VII | VII |

FIG. 6B (R - P) VS. S TABLE

| R - P | 1 | 2 | 3 | 4 | 5 | 6 | 7 | 8 | 9 | 10 | 11 |
|---|---|---|---|---|---|---|---|---|---|---|---|
| S | VII | VII$^b$ | VI | VI$^b$ | V | V$^b$ | IV | III | III$^b$ | II | II$^b$ |

FIG. 7 x, S VS. SCALE TABLE (FOR KEY=MAJOR)

| x \ S | I | II$^b$ | II | III$^b$ | III | IV | V$^b$ | V | VI$^b$ | VI | VII$^b$ | VII |
|---|---|---|---|---|---|---|---|---|---|---|---|---|
| M | Ion | Lyd | Ion | Lyd | Ion | Lyd | Lyd | Mix | Lyd | Ion | Lyd | Ion |
| m | Aeo | Dor | Dor | Dor | Phr | Dor | Phr | Dor | Dor | Aeo | Dor | Dor |
| 7 | Mix | Ld7 | Mix | Ld7 | Hmp | Ld7 | Ld7 | Mix | Ld7 | Hmp | Ld7 | Hmp |
| M7 | Ion | Lyd | Ion | Lyd | Ion | Lyd | Lyd | Ion | Lyd | Ion | Lyd | Ion |
| m7 | Aeo | Dor | Dor | Dor | Phr | Dor | Phr | Dor | Dor | Aeo | Dor | Dor |
| ⋮ | ⋮ | ⋮ | ⋮ | ⋮ | ⋮ | ⋮ | ⋮ | ⋮ | ⋮ | ⋮ | ⋮ | ⋮ |

PITCH SHIFT TABLE (FOR P=C)

| NOTE \ SCALE | Ion | Dor | Phr | Lyd | Mix | Aeo | Loc | Ld7 | Hmp | ..... |
|---|---|---|---|---|---|---|---|---|---|---|
| C | 0 | 0 | 0 | 0 | 0 | 0 | 0 | 0 | 0 | ..... |
| C♯ | -1 | +1 | 0 | -1 | -1 | +1 | 0 | -1 | 0 | ..... |
| D | 0 | 0 | -1 | 0 | 0 | 0 | -1 | 0 | -1 | ..... |
| D♯ | +1 | 0 | 0 | +1 | +1 | 0 | 0 | +1 | +1 | ..... |
| E | 0 | -1 | -1 | 0 | 0 | -1 | -1 | 0 | 0 | ..... |
| F | 0 | 0 | 0 | +1 | 0 | 0 | 0 | +1 | 0 | ..... |
| F♯ | +1 | +1 | +1 | 0 | +1 | +1 | 0 | 0 | +1 | ..... |
| G | 0 | 0 | 0 | 0 | 0 | 0 | -1 | 0 | 0 | ..... |
| G♯ | -1 | +1 | 0 | -1 | -1 | 0 | 0 | -1 | 0 | ..... |
| A | 0 | 0 | -1 | 0 | 0 | -1 | -1 | 0 | -1 | ..... |
| A♯ | +1 | 0 | 0 | +1 | 0 | 0 | 0 | 0 | 0 | ..... |
| B | 0 | -1 | -1 | 0 | -1 | -1 | -1 | -1 | -1 | ..... |

MAJOR VS. MINOR DISTANCE TABLE

| | | | | | | | |
|---|---|---|---|---|---|---|---|
| MAJOR DISTANCE S | I | II | III | IV | V | VI | VII |
| MINOR DISTANCE S' | III | IV | V | VI | VII | I | II |

FIG. 12A
PRIOR ART
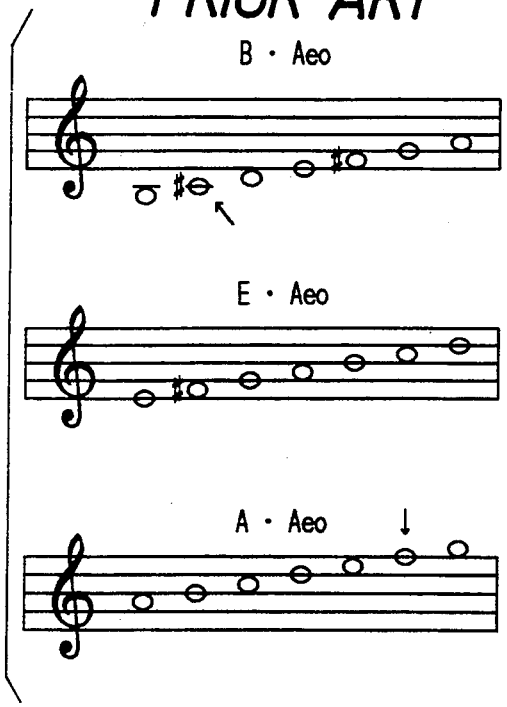
FIG. 12B
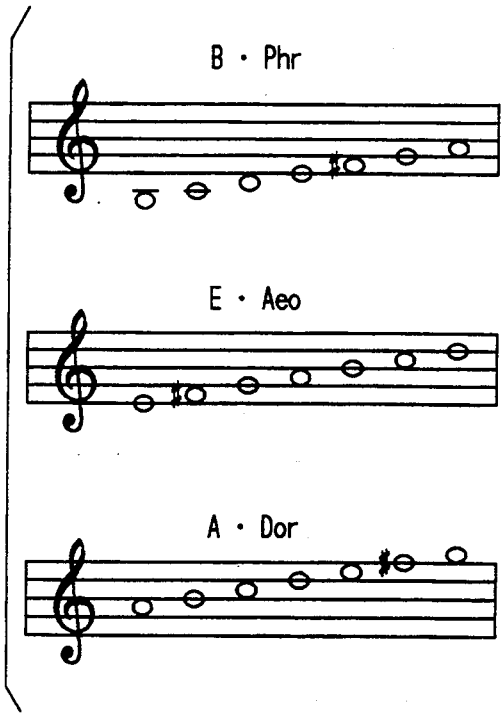
FIG. 13
| SCALE SYMBOL | SCALE NAME | SCALE SYMBOL | SCALE NAME |
|---|---|---|---|
| Ion | IONIAN | Aeo | AEOLIAN |
| Dor | DORIAN | Loc | LOCRIAN |
| Phr | PHRYGIAN | Ld7 | LYDIAN 7TH |
| Lyd | LYDIAN | Hmp | HARMONIC MINOR PERFECT 5TH DOWN |
| Mix | MIXOLYDIAN | | |

CHORD TYPE VS. SCALE TABLE

| CHORD TYPE (x) | SCALE |
|---|---|
| M | Ion (IONIAN) |
| m | Aeo (AEOLIAN) |
| 7 | Mix (MIXOLYDIAN) |
| M7 | Ion (IONIAN) |
| m7 | Aeo (AEOLIAN) |
| ⋮ | ⋮ |

ELECTRONIC MUSICAL INSTRUMENT HAVING MELODY CORRECTION CAPABILITIES

BACKGROUND OF THE INVENTION

1. Field of the Invention

The present invention is related to electronic musical instruments which generate musical tones according to melody pattern information, and particularly, to electronic musical instruments in which the scale of a melody can be modified by specifying a chord progression and key.

2. Description of the Prior Art

Electronic musical instruments have conventionally been known wherein a user inputs a melody pattern such as a melody accompaniment from a panel or the like or selects a previously registered pattern, and supplies an arbitrary chord progression to the melody pattern, thereby to convert the scale according to a chord and generate musical tones. In such electronic musical instruments, conventionally, only one of the scales such as Ionian, Aeolian and the like has been made to correspond to chord types such as M (major) and m (minor).

FIG. 14 is a flowchart representing a typical operation of such conventional electronic musical instruments as described above. In step S30, a key and a chord progression is input. Each chord information of the chord progression is input along with its switching timing information and stored in a memory. It is assumed here that the input key is G and the chord progression is [Bm7- Em7-Am7-. . . ], for instance. In step S31, 1 is set in a chord counter i. In step S32, the chord type(x) vs. scale table of FIG. 15 is used to decide a scale according to the type of the input chord(x). In step S33, the melody pattern is modified so as to suit the scale decided in step S32 and musical tones are generated. In step S34, 1 is added to the counter i, and in step S35, it is examined whether or not the value of the counter i has exceeded the number of chords n; if not, the operation flow returns to step S32 to repeat decision of a scale corresponding to the next chord and modification of the scale of the melody pattern, thereby for playing the melody.

FIG. 12A is an example of the scales selected by the conventional method. Since the chord types of the input chord progression [Bm7-Em7-Am7-. . . ] are all m7, Aeolian is chosen for all according to the table of FIG. 15. Accordingly, the scales as shown in FIG. 12A are selected from the root of each chord. However, comparing these scales with a major scale which has G as tonic, there are mismatches in intervals as shown by arrows.

By nature, tones according with a scale sound musically natural, whereas those disaccording with a scale sound very unnatural. However, conventional method as described above had a problem that if an arbitrary chord progression was given to a melody pattern such as a accompaniment pattern to generate the musical tones of the melody pattern, scale-out tones corresponding to a specified key sometimes occurred.

SUMMARY OF THE INVENTION

It is the object of the present invention to improve the prior art problem as described above and provide electronic musical instruments wherein when a chord is specified for a melody, a scale suitable for the chord function can be automatically selected for the chord type, thereby to play the melody.

The present invention presents electronic musical instruments which generate musical tones according to melody pattern information, characterized by having pitch shift means for automatically making a pitch shift to each tone of a melody pattern according to the chord progression and key supplied by the user to the melody pattern. Such means makes It possible to easily have a musically natural melody.

BRIEF DESCRIPTION OF THE DRAWING

FIG. 5 is a note vs. numeric value correspondence table.

FIGS. 6A and 6B are (P−R) and (R−P) vs. distance S correspondence tables.

FIG. 7 is a combination of x and S vs. scale correspondence table.

FIGS. 12A and 12B are examples of the scales chosen by the prior art example and the present invention.

FIG. 13 is a table showing the correspondence of scale symbols and scale names.

DETAILED DESCRIPTION OF THE PREFERRED EMBODIMENT

Figure 1:
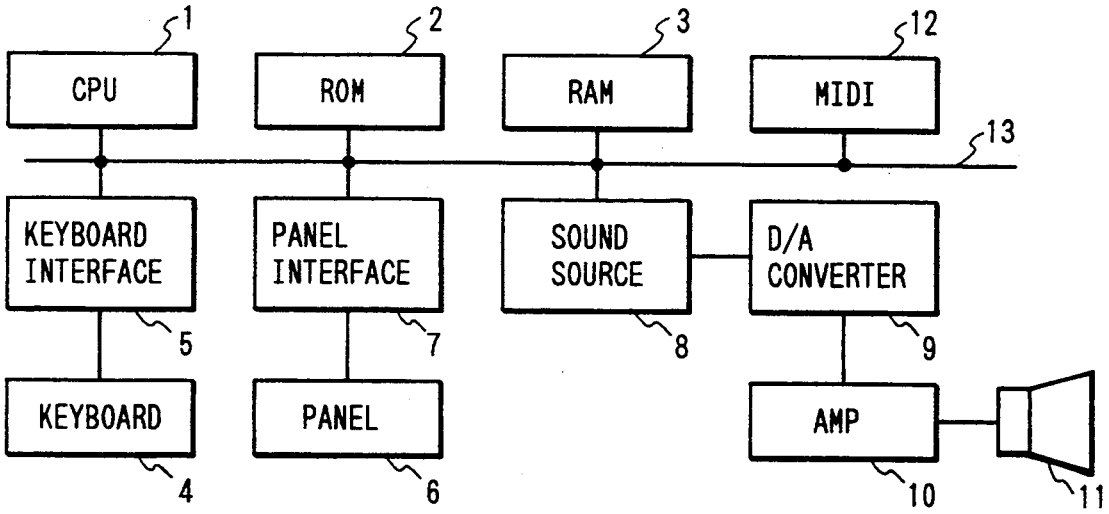
FIG. 1 is a block diagram representing the hardware configuration of the electronic musical instruments of an embodiment of the present invention.

Referring to the drawing, a detailed description is now made to an embodiment of the electronic musical instruments to which the present invention is applied.

FIG. 1 is a block diagram representing the hardware configuration of the electronic musical instruments of the embodiment of the present invention. CPU 1 performs the overall control of the electronic musical instruments such as key assign and tone control. ROM 2 stores programs and data which are necessary for the control. In RAM 3, the various control data within the instruments or MIDI (Musical Instrument Digital Interface) data are stored.

Keyboard 4 comprises a plurality of keys each equipped with a switch, and keyboard interface circuit 5 scans the keyboard switches to detect their ON/OFF under the control of CPU 1. Panel 6 comprises various switches and a display such as LCD or LED. Panel interface circuit 7 reads in the status of the various switches and/or outputs various information to the display under the control of CPU 1.

Sound source circuit 8, for example, reads out a waveform signal from an internal waveform memory at an address interval corresponding to a specified frequency under the control of CPU 1, and multiplies the envelope signal to generate a digital musical tone waveform. Sound source circuit 8 is generally constructed such that a plurality of channels can be concurrently operated by a time division multiplex processing to add and synthesize a plurality of digital musical tone signals. D/A converter 9 converts the digital musical tone signal output from sound source circuit 8 to an analog signal. Amplifier 10 amplifies and supplies an analog musical tone signal to speaker 11 to generate musical tones.

MIDI interface circuit 12 is to send/receive a MIDI signal between an external MIDI compatible equipment, and bus 13 connects the various circuits mentioned above in the electronic musical instruments each other. In addition, an FDD (floppy disk drive), a memory card interface circuit and the like may be provided as needed.

Figure 2:
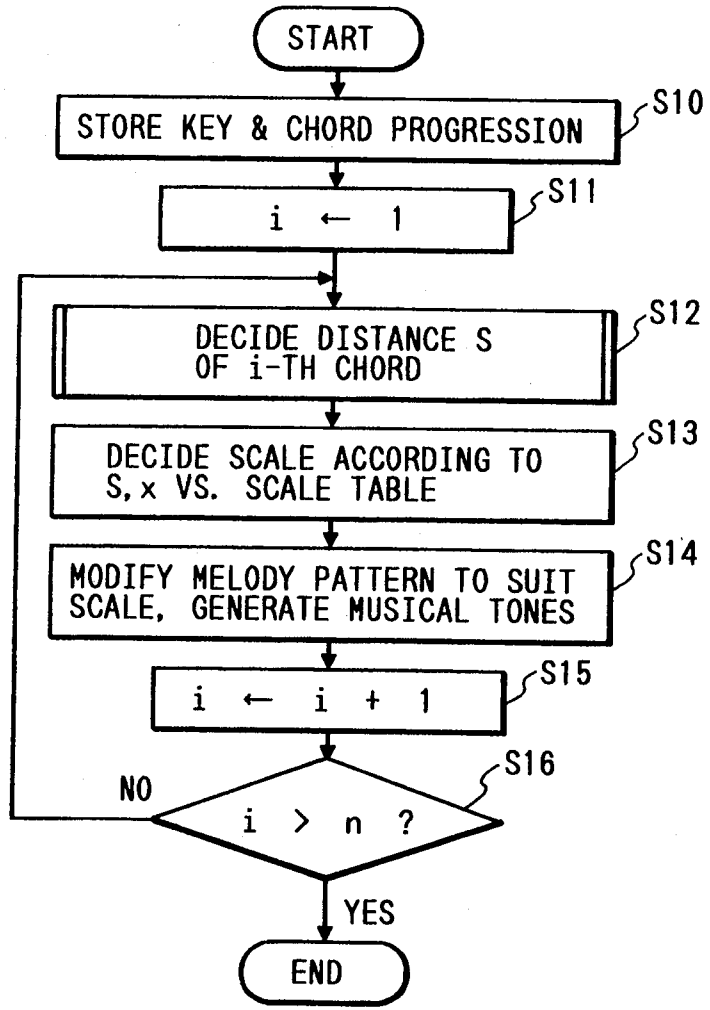
FIG. 2 is a flowchart representing the outline of the pitch shift process of the embodiment.

FIG. 2 is a flowchart representing the outline of the pitch shift operation in the above embodiment for automatically playing a melody pattern already stored in the memory. The melody pattern is input by using (notes of) a C major scale or stored in advance. In step S10, a chord progression and a key are input or taken in. It is now assumed that the input chord progression is [Bm7–Em7–Am7–. . . ] and the key is G major, for example. In step S11, 1 is set in chord counter i. In step S12, the distance S between the root P of the i-th chord fetched from the memory and the tonic R of the key is decided as shown in FIG. 3.

Figure 3:
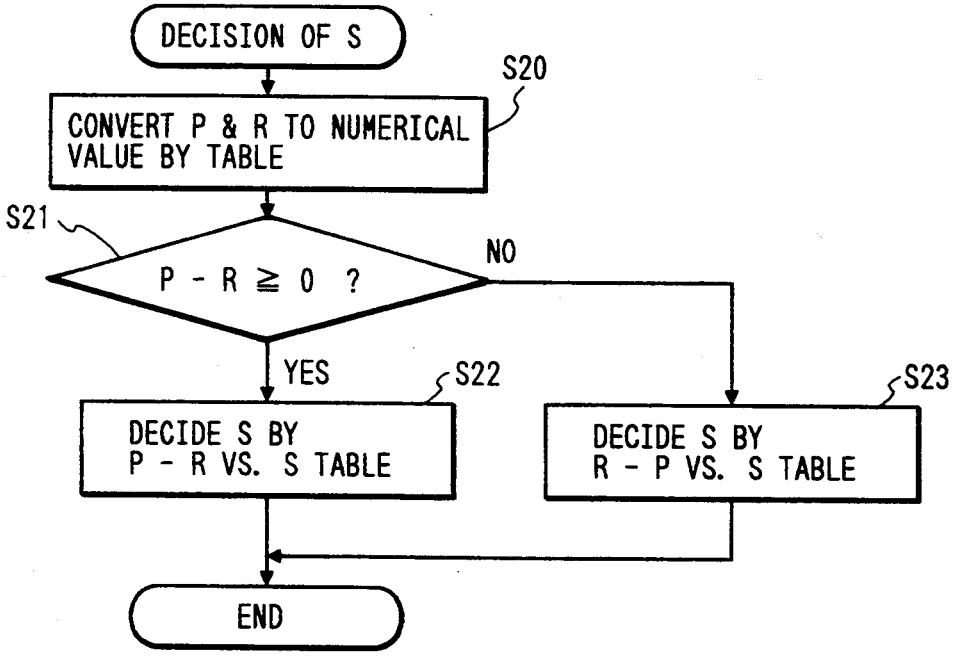
FIG. 3 is a flowchart showing the decision process of distance S.

FIG. 3 is a flowchart showing an operation for deciding the distance S. In step S20, the root P of the chord and the tonic R of the key are numerically expressed according to the note vs. numeric value correspondence table of FIG. 5. In step S21, it is examined whether or not the value (P−R) is positive, and if the result is yes, the process flows to step S22 where the distance S is decided according to the (P−R) vs. S correspondence table of FIG. 6A. On the other hand, (P−R) is negative, the process skips to step S23 where the distance S id decided according to the (R−P) vs. S correspondence table of FIG. 6B.

Since it has been assumed that the chord progression is [Bm7–Em7–Am7–. . . ] and the key is G major, the root P is [B–E–A–. . . ] and the tonic R is G. Since the numeric values corresponding to the root P and the tonic R(=G) are [2, 7, 0, . . . ] and 10, respectively, and (P−R) becomes negative for all of roots, the judgment in step S21 is negative and step S23 is entered. When the values of (R−P), that is [8, 3, 10, . . . ], is converted according to the table of FIG. 6B, [III, VI, II, . . . ] are obtained as distances S corresponding to them.

Returning to FIG. 2, in step S13, scales corresponding to the distances S and chord types x are decided according to the x, S vs. scale correspondence table of FIG. 7. Since the chord types x are all m7, the scales are Phr (Phrygian), Aeo (Aeolian) and Dor (Dorian). The correspondence table of the symbols of FIG. 7 and scale names is shown in FIG. 13.

Figure 4:
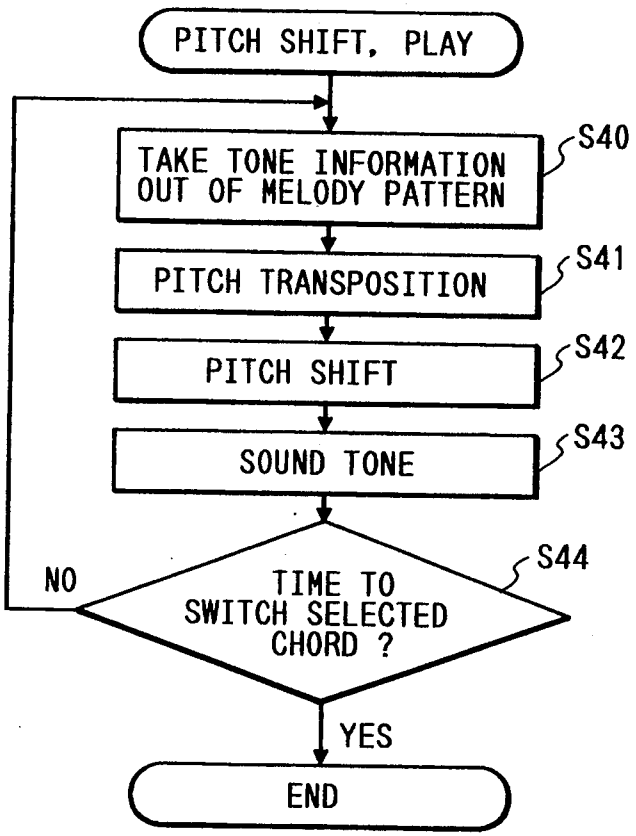
FIG. 4 is a flowchart showing a pitch shift of pitch and play processing.

In step S14, the melody pattern is modified so as to accord with a scale and played. FIG. 4 is a flowchart showing the detail of the process in step S14. In step S40, a piece of tone information is taken out of the melody pattern data to be played. In step S41, the pitch is transposed according to the difference between C which is the tonic corresponding to the melody pattern, and the root of the currently specified chord.

Figures 8, 9, 10:
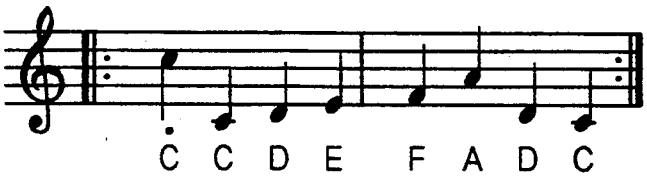
FIG. 8 is an example of a pitch shift table.
FIG. 9 is a major vs. minor correspondence table.
FIG. 10 is a score showing an example of the accompaniment melody pattern.

In step S42, the pitch is modified according to the pitch shift table of FIG. 8 so as to accord with the scales decided in step S13. FIG. 8 shows shift values when the root of the specified chord is C, in which +1 means to sharp by a semitone and −1 means to flat by a semitone. For other roots, it is only needed to rotate only the note symbols such as C, D, etc. in the column of notes so that the root of a specified chord is at the head (top). For instance, if the root of the specified chord is B and the scale is Phr, the symbols representing notes in FIG. 8 is rotated so that B is at the head. That is, the symbols other than B are put down one by one. Then, looking at the column of Phr, the shift value for the tone of the note F is +1, and thus, if data of F is read out, it is modified to F# sharped by a semitone.

In step S43, parameters are set in the sound source circuit 8 of FIG. 1 according to the modified pitch information and a sounding operation is initiated. In step S44, it is examined whether or not the switching timing of the currently selected chord in a chord progression has been reached, and if not, the flow returns to step S40 where to process the next tone information of the melody pattern data in the same manner as mentioned above.

Returning to FIG. 2, in step S15, 1 is added to counter 1, and in step S16, it is examined whether or not the value of counter i has exceeded the number of chord data; if not, steps S12 to S16 are repeated to decide a distance S and scale corresponding to the next chord, and the scale is modified to continue the playing of the melody. By the operation as described above, it is possible to play the melody while automatically modified it according to a chord and key.

FIG. 9 is a major vs. minor correspondence table. A key may be specified to be either major or minor. When the key is specified to be minor, a distance S′ is first decided in step S12 of FIG. 2 with ignoring the difference in key specification, then thus decided distance S′ is converted to a major distance S according to the correspondence table of FIG. 9, so that the processings of and after step S13 can be standardized. In the example described above, a selected scale would be the same if the key is specified to be E minor instead of G major.

FIG. 10 is a score showing an example of the accompaniment melody pattern. The melody pattern can be set in any length, and after the last portion of the melody pattern is played, the playing is repeated again by returning to the head of it.

Figure 11:
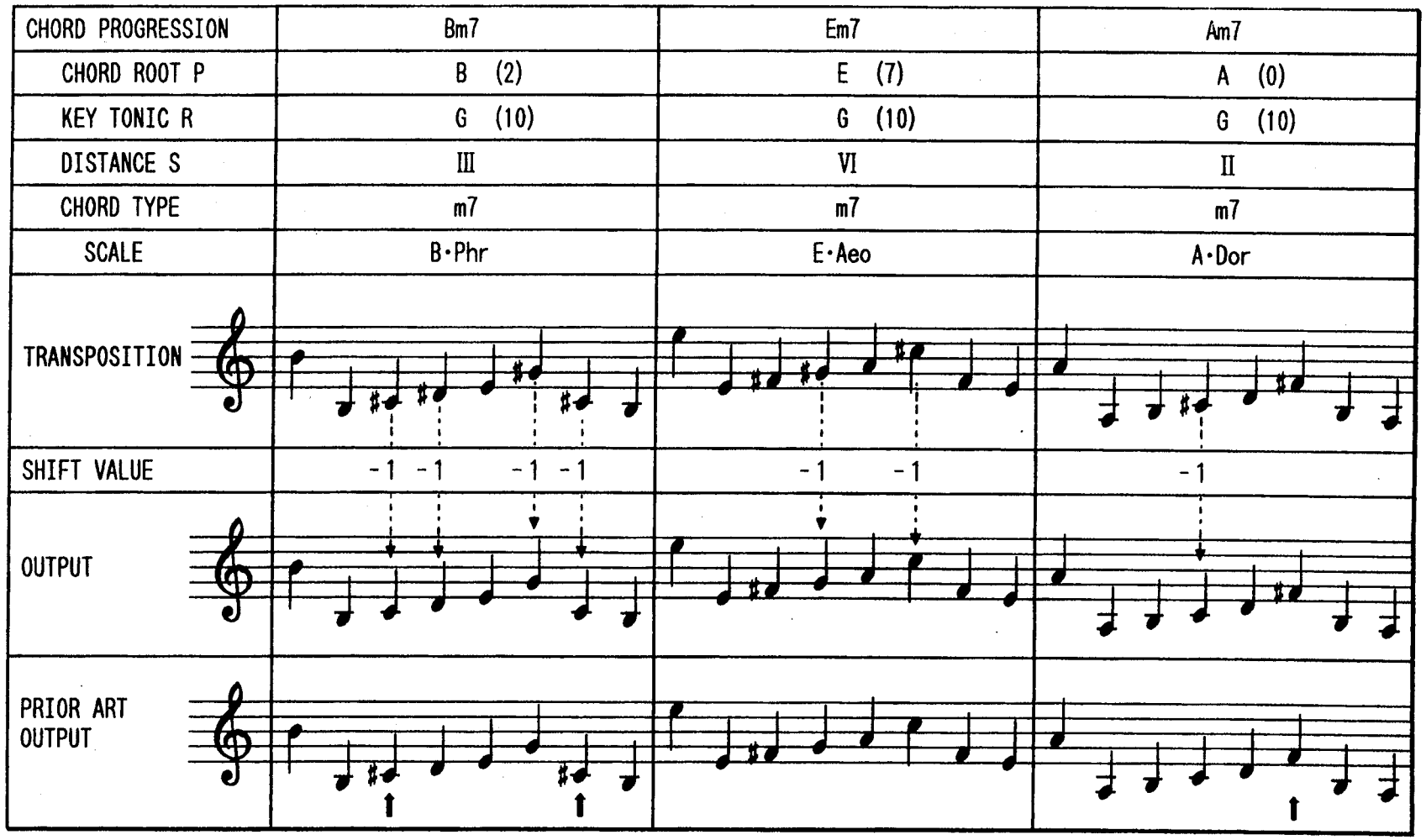
FIG. 11 is a table showing a pattern conversion example according to a chord progression.
Figures 14, 15:
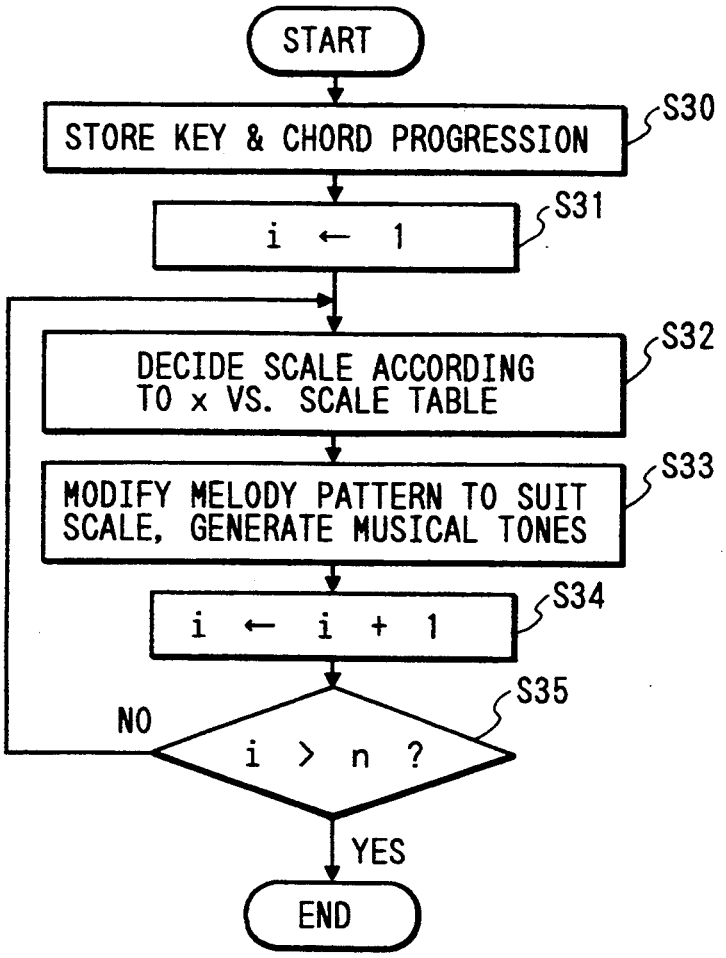
FIG. 14 PRIOR ART
FIG. 14 is a flowchart representing the operation of the conventional electronic musical instruments.
FIG. 15 is a conventional chord type vs. scale correspondence table.

FIG. 11 shows an example of data conversion for the case that the melody pattern of FIG. 10 is supplied with the chord progression [Bm7–Em7–Am7–. . . ] and the key of G major, as described above. In addition, it is assumed that chord change occurs at every two bars. First, on the basis of the root P of each chord and the tonic R of the key, a distance S is decided according to the table of FIG. 6A or 6B, and on the basis of the distance S and the chord type of each chord, a scale corresponding to each chord is decided according to the table of FIG. 7. In FIG. 11, B Phrygian is selected as the scale for the first chord Bm7 in the chord progression, and then E Aeolian and A Dorian are selected sequentially.

FIG. 12B shows each scale selected in the above procedure. Each of the scales B Phr, E Aeo and A Dor has the same key signature (one sharp) and note as major scales whose tonic is G. Then, tone information is taken out from the melody pattern one by one, and the pitch is transposed according to the difference between C, the tonic for the melody pattern, and the root P of the currently specified chord. For instance, (C, C, D, E, F, A, D, C), the tones of the melody pattern, are converted to (B, B, C#, D#, E, G#, C#, B), respectively. Further, according to the decided scale and the root of the chord, the shift value of each transposed tone is read out from the table of FIG. 8. For instance, if the scale is Phr and the root of the chord is B, the shift values corresponding to the notes (B, B, C#, D#, E, G#, C#, B) are (0, 0, −1, −1, 0, −1, −1, 0). Accordingly, the transposed tones are modified by the shift values to (B, B, C, D, E, G, C, B), as shown in the output column In FIG. 11. In addition, if the scale selection method of the prior art example is used, the chord types of the respective chords are all m7 and thus the Aeolian scale would be selected for all, which would cause scale-out tones as shown (by arrows) in the bottom of FIG. 11.

Although an embodiment of the present invention has been described above, the present invention can also be modified as follows. The above embodiment is a pitch shift of previously stored melody data, but a similar pitch shift may be applied to, for instance, inputs from a keyboard or data which are input in real time by external MIDI signals or the like. That is, once a chord progression and a key are previously input and a pitch shift operation is activated, if the keys of notes which are not included in a chosen scale are depressed on an internal or external keyboard, all the generated notes are modified to notes on the chosen scale. Accordingly, if a person who is not a good player of instruments plays, he can easily enjoy an ad-lib feeling. In addition, the keys for one octave of the lowest range of the keyboard can be used for inputting chords to input chord information in real time.

As described above, in accordance with the present invention, a musically natural melody can easily be obtained by automatically selecting a scale suitable for the function of a chord.

What is claimed is:

1. An electronic musical instrument which generates musical tones according to a melody pattern having a corresponding key information and a plurality of notes, wherein each note represents a pitch, and according to a chord progression having a plurality of chords, wherein each chord includes a root, and wherein the melody pattern and chord progression comprise inputs to the electronic musical instrument, the electronic musical instrument comprising:

note outputting means for outputting a note from the melody pattern;

key information outputting means for outputting the corresponding key information from the melody pattern;

chord outputting means for outputting a chord;

pitch modifying means operably connected to the note outputting means for modifying the note on a semi-tone basis according to the chord and the key information; and means operably connected to the pitch modifying means for generating musical tones based on the modified note.

2. The electronic musical instrument of claim 1 wherein the pitch modifying means includes:

scale extraction means operably connected to the key information outputting means and the chord outputting means for obtaining a scale based on the key information and the chord; and pitch shift means operably connected to the scale extraction means for shifting the note according to the scale.

3. The electronic musical instrument as set forth in claim 2 wherein the scale extraction means comprises:

distance calculation means operably connected to the key information outputting means and the chord outputting means for calculating a musical distance between the key information and the root;

chord type extractions means operably connected to the chord outputting means for obtaining a chord type based on the chord;

scale table means operably connected to the distance calculations means and the chord type extraction means for storing therein a plurality of scales to be referenced by the musical distance and chord type; and wherein the pitch shift means comprises:

pitch shift table means operably connected to the outputting means and scale table means for storing therein pitch shift information to be referenced by the scale and the note; and means operably connected to the pitch shift table means for modifying the note so as to be in accordance with the pitch shift table means.

4. The electronic musical instrument as set forth in claim 1 and further comprising:

storage means for storing therein at least one of the melody patterns and the chord progression.

5. An electronic musical instrument as set forth in claim 1 wherein the melody pattern is input in real time from at least one of a keyboard and a MIDI interface and further having one of a keyboard and a MIDI interface.

6. The electronic musical instrument as set forth in claim 1 wherein the chord progression information is input in real time from at least one of a keyboard and a MIDI interface and further having one of a keyboard and a MIDI interface.

7. The electronic musical instrument as set forth in claim 1 and further comprising:

transposition means for an operably connected to the note outputting means, the key information outputting means, and the chord outputting means for transposing the note according to the chord and the key information before modifying each note.

* * * * *